US007743819B2

(12) United States Patent
Liu et al.

(10) Patent No.: US 7,743,819 B2
(45) Date of Patent: Jun. 29, 2010

(54) HEAT PIPE AND METHOD FOR PRODUCING THE SAME

(75) Inventors: Tay-Jian Liu, Tu-Cheng (TW); Chao-Nien Tung, Tu-Cheng (TW); Chuen-Shu Hou, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 394 days.

(21) Appl. No.: 11/309,248

(22) Filed: Jul. 19, 2006

(65) Prior Publication Data

US 2007/0240854 A1 Oct. 18, 2007

(30) Foreign Application Priority Data

Apr. 14, 2006 (CN) ..... 2006 1 0060289

(51) Int. Cl.
*F28D 15/04* (2006.01)

(52) U.S. Cl. ..... 165/104.26; 165/104.21

(58) Field of Classification Search ..... 165/104.21, 165/104.26; 361/700; 174/15.2
See application file for complete search history.

(56) References Cited

U.S. PATENT DOCUMENTS

| | | | | | |
|---|---|---|---|---|---|
| 3,786,861 | A * | 1/1974 | Eggers | ..... | 165/104.26 |
| 3,901,311 | A | 8/1975 | Kosson et al. | | |
| 4,004,441 | A | 1/1977 | Leszak | | |
| 4,196,504 | A * | 4/1980 | Eastman | ..... | 165/104.26 |
| 5,780,928 | A * | 7/1998 | Rostoker et al. | ..... | 257/713 |
| 2004/0011512 | A1 * | 1/2004 | Noda et al. | ..... | 165/104.26 |
| 2005/0077030 | A1 | 4/2005 | Wong | | |

FOREIGN PATENT DOCUMENTS

| | | | |
|---|---|---|---|
| CN | 1624411 | A | 6/2005 |
| TW | 589444 | | 6/2004 |
| WO | WO 2004/036644 | * | 4/2004 |

* cited by examiner

*Primary Examiner*—Teresa J Walberg
(74) *Attorney, Agent, or Firm*—Jeffrey T. Knapp

(57) ABSTRACT

A heat pipe and a method for producing the heat pipe are disclosed. The heat pipe includes a hollow metal casing and a honeycombed wick structure arranged at an inner surface of the hollow metal casing. The wick structure includes a plurality of slices stacked together. Each of the slices defines a plurality of pores therein to form a plurality of micro-channels in the wick structure, whereby porosity of the wick structure can be accurately controlled.

4 Claims, 10 Drawing Sheets

HEAT PIPE AND METHOD FOR PRODUCING THE SAME

FIELD OF THE INVENTION

The present invention relates generally to an apparatus for transfer or dissipation of heat from heat-generating components, and more particularly to a heat pipe and a method of producing the heat pipe having a multiple micro-channel wick structure.

DESCRIPTION OF RELATED ART

It is well known that a heat pipe is generally a vacuum-sealed pipe. A porous wick structure is provided on an inner face of the pipe, and the pipe is filled with at least a phase changeable working media employed to carry heat. Generally, according to positions from which heat is input or output, the heat pipe has three sections, an evaporating section, a condensing section and an adiabatic section between the evaporating section and the condensing section.

In use, the heat pipe transfers heat from one place to another place mainly by virtue of phase change of the working media taking place therein. Generally, the working media is liquid such as alcohol, water and the like. When the working media in the evaporating section of the heat pipe is heated up, it evaporates, and a pressure difference is thus produced between the evaporating section and the condensing section in the heat pipe. As a result vapor with high enthalpy flows to the condensing section and condenses there. Then the condensed liquid reflows to the evaporating section along the wick structure. This evaporating/condensing cycle continues in the heat pipe; consequently, heat can be continuously transferred from the evaporating section to the condensing section. Due to the continual phase change of the working media, the evaporating section is kept at or near the same temperature as the condensing section of the heat pipe.

However, during the phase change of the working media, the resultant vapor and the condensed liquid flows along two opposite directions, which reduces the speed of the condensed liquid in returning back to the evaporating section and therefore limits the heat transfer performance of the heat pipe. As a result, a heat pipe often suffers from drying-out at the evaporating section as the condensed liquid cannot be timely sent back to the evaporating section of the heat pipe.

In general, movement of the working fluid from the condensing section to the evaporating section depends on capillary action of the wick structure. The wick structure currently available for the heat pipe includes fine grooves integrally formed at the inner walls of the casing, screen mesh or bundles of fiber inserted into the casing and held against the inner walls thereof, or sintered powder combined to the inner walls through a sintering process. However it is hard to obtain consistent characters during mass production of these wicks. Porosity of the wicks can be hard to control, which leads to varying thermal performance. Furthermore, the porosity of the wicks is limited to a small range, whereby a thermal resistance of the heat pipe can be slightly high. This also affects the heat dissipating performance of the heat pipe.

Therefore, it is desirable to provide a heat pipe having a wick structure which can over the shortcomings of the conventional art.

SUMMARY OF THE INVENTION

The present invention relates, in one aspect, to a heat pipe. The heat pipe includes a hollow metal casing and a honeycombed wick structure arranged at an inner surface of the hollow metal casing. The wick structure includes a plurality of slices stacked together. Each of the slices defines a plurality of pores therein to form a plurality of micro-channels in the wick structure, whereby porosity of the wick structure can be accurately controlled.

The present invention relates, in another aspect, to a method for producing a heat pipe. The method includes the following steps: 1) providing a mandrel; 2) positioning a vapor-liquid isolation structure on an outer circumferential surface of the mandrel; 3) intimately attaching a honeycombed wick structure on the isolation structure, wherein the wick structure includes a first slice and a second slice and the first and second slices are alternately stacked together; 4) coaxially inserting the mandrel into a hollow casing; 5) placing the casing into an oven and heating it under a high temperature to sinter the wick structure, the isolation structure and the casing together; 6) extracting the mandrel out of the casing, filling working liquid into the casing, vacuuming the casing and sealing the casing. Through these steps, the heat pipe with the honeycombed wick structure can be produced.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present device can be better understood with reference to the following drawings. The components in the drawings are not necessarily drawn to scale, the emphasis instead being placed upon clearly illustrating the principles of the present device. Moreover, in the drawings, like reference numerals designate corresponding parts throughout the several views.

DETAILED DESCRIPTION OF THE INVENTION

Figure 1:
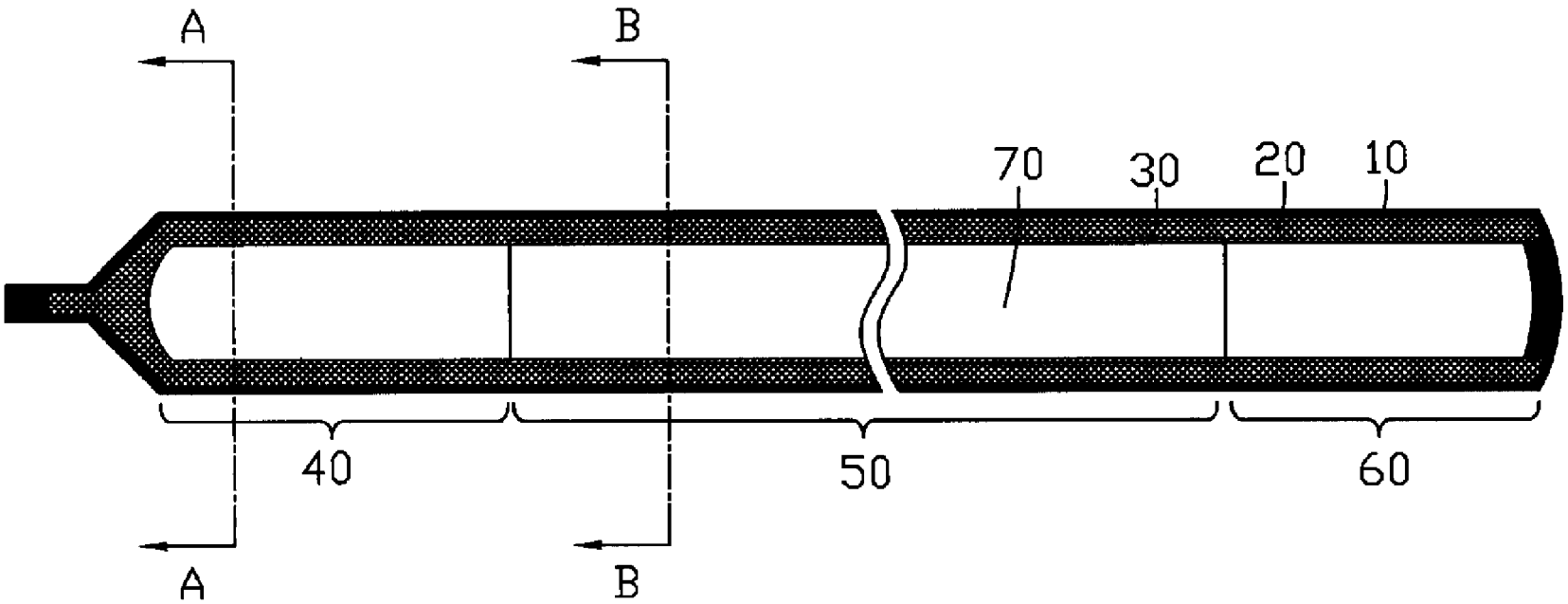
FIG. 1 is a longitudinally cross-sectional view of a heat pipe in accordance with a first embodiment of the present invention.

FIG. 1 illustrates a heat pipe in accordance with a first embodiment of the present invention. The heat pipe includes a sealed hollow metal casing 10 having an inner surface and a capillary wick 20 arranged at the inner surface of the casing 10. The inner surface of the casing 10 may be smooth or may define a plurality of micro-grooves therein.

The casing 10 includes an evaporating section 40 and a condensing section 60 at respective opposite ends thereof, and an adiabatic section 50 located between the evaporating section 40 and the condensing section 60. The casing 10 is typically made of highly thermally conductive materials such as copper or copper alloys. The capillary wick 20 is saturated with a working fluid (not shown), which acts as a heat carrier for carry thermal energy from the evaporating section 40 toward the condensing section 60 when undergoing a phase transition from liquid state to vaporous state. A vapor channel 70 is defined in the casing 10 along a lengthwise direction of the heat pipe.

A vapor-liquid isolation structure 30 is formed in the casing 10, for providing passage of the vapor. The isolation structure 30 is made of a metal slice or a metal thin-walled tube and attached on an inner face of the capillary wick 20 of the adiabatic section 50, for isolating the capillary wick 20 from the vapor channel 70 to overcome the dry-out problem of the conventional art. Two free ends of the isolation structure 30 may extend towards the evaporating section 40 and the condensing section 60.

Figure 2:
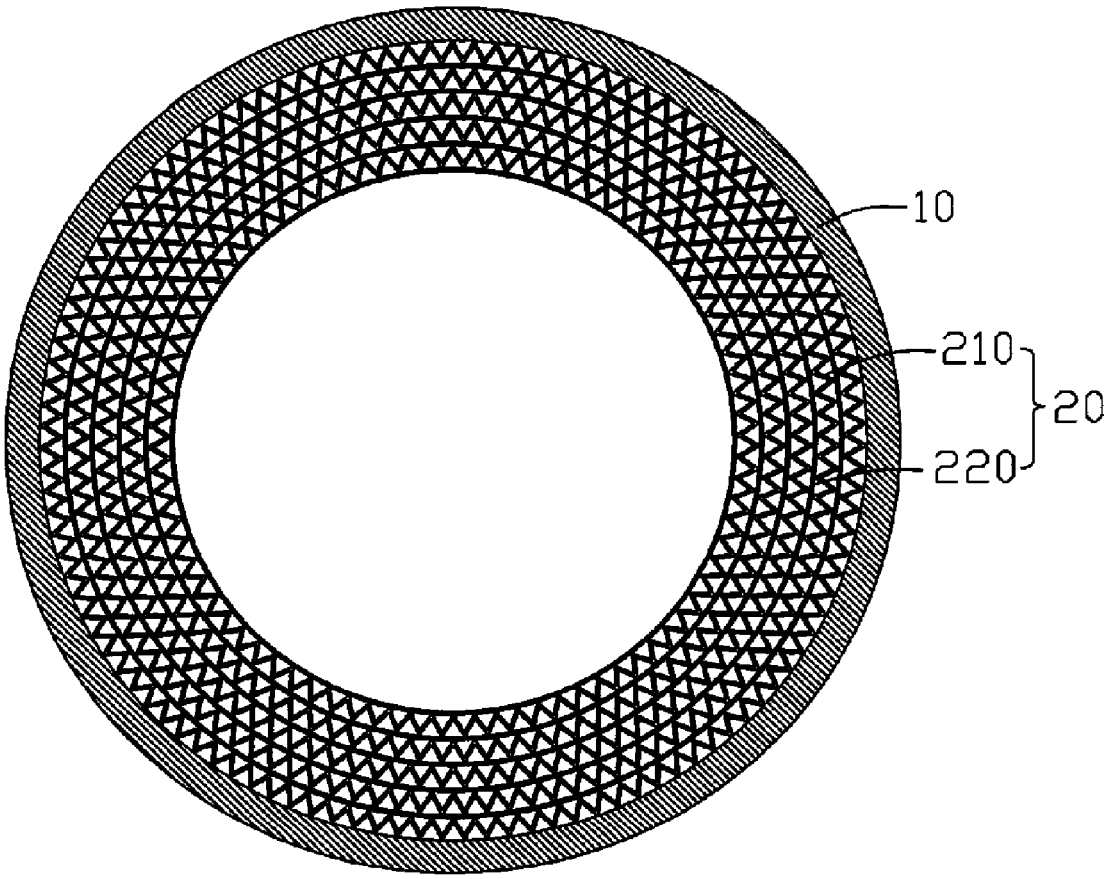
FIG. 2 is a transversely cross-sectional view of the heat pipe of FIG. 1, taken along line A-A thereof, wherein the heat pipe forms a wick structure arranged at an inner surface thereof, and the wick structure including a first slice and a second slice.
Figure 3:
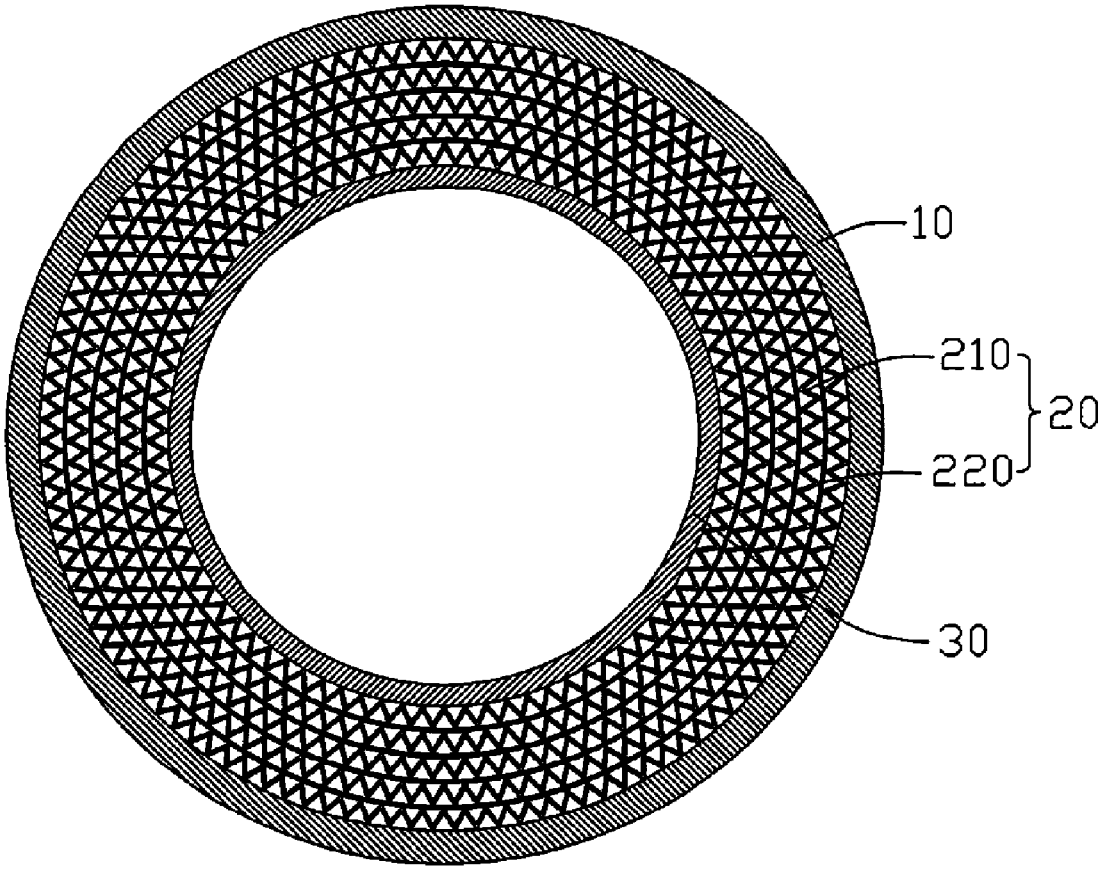
FIG. 3 is a transversely cross-sectional view of the heat pipe of FIG. 1, taken along line B-B thereof.

Referring to FIGS. 2-3, the capillary wick 20 comprises a first slice 210 attached on the inner surface of the casing 10 and a second slice 220 attached on the first slice 210. In this embodiment, the capillary wick 20 has a multiple layer structure consisting of a plurality of alternately stacked first slices 210 and second slices 220.

Figure 4:
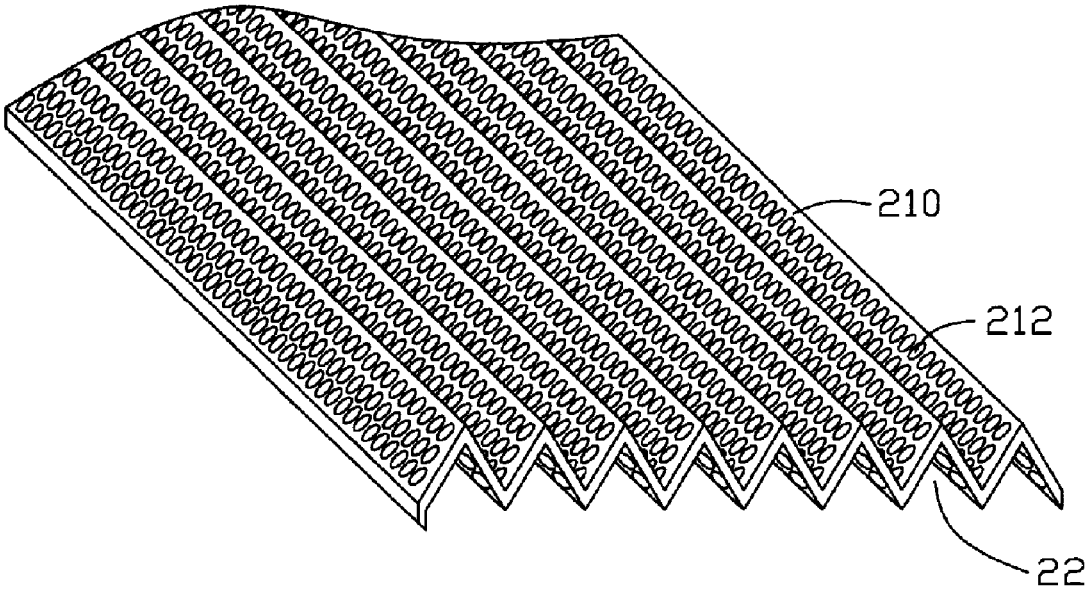
FIG. 4 is an enlarged view of the first slice of FIG. 2.
Figure 5:
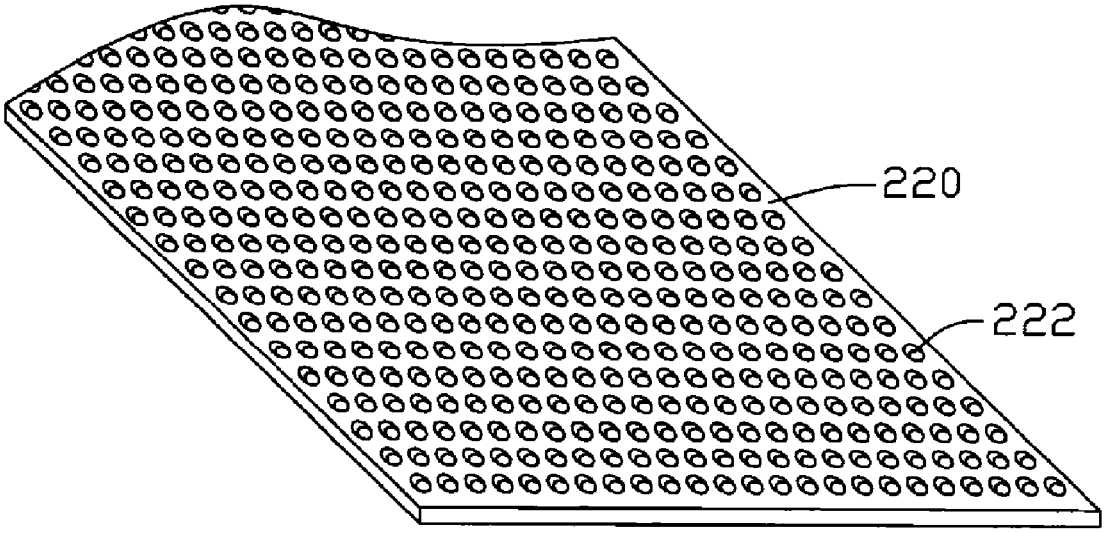
FIG. 5 is an enlarged view of the second slice of FIG. 2.

Referring to FIGS. 4-5, the first slice 210 has a triangular waved configuration. The second slice 220 has a plate type configuration. The first and second slices 210, 220 respectively define a plurality of pores 212, 222 to form the capillary wick 20 having a honeycomb-like structure with a plurality of micro-channels 22 for reflowing of the condensed liquid.

Specifically, when the working fluid contained in the capillary wick 20 receives heat from a heat source in thermal connection with the evaporating section 40 of the heat pipe 10 and turns into vapor, the vapor is quickly transferred toward the condensing section 60 via the vapor channel 70 surrounded by the isolation structure 30 at the adiabatic section 50. At the condensing section 60, the vapor releases its heat and turns into liquid. Then, the condensed liquid is brought back, via the capillary wick 20, to the evaporating section 40 of the heat pipe where it is available again for evaporation.

Due to the capillary wick 20 being made of slices, it is easy to obtain a high consistency during mass production. Accordingly, porosity of the capillary wick 20 is relatively easy to control and heat transfer performance of the heat pipe is thereby improved.

The pores 212, 222 can be round in shape, although other shapes such as rectangular or triangular or the like may also be suitable, to allow the control of the porosity of the capillary wick 20. In addition, the pores 212, 222 may be defined on the first and second slices 210, 220 regularly or irregularly.

Figure 6:
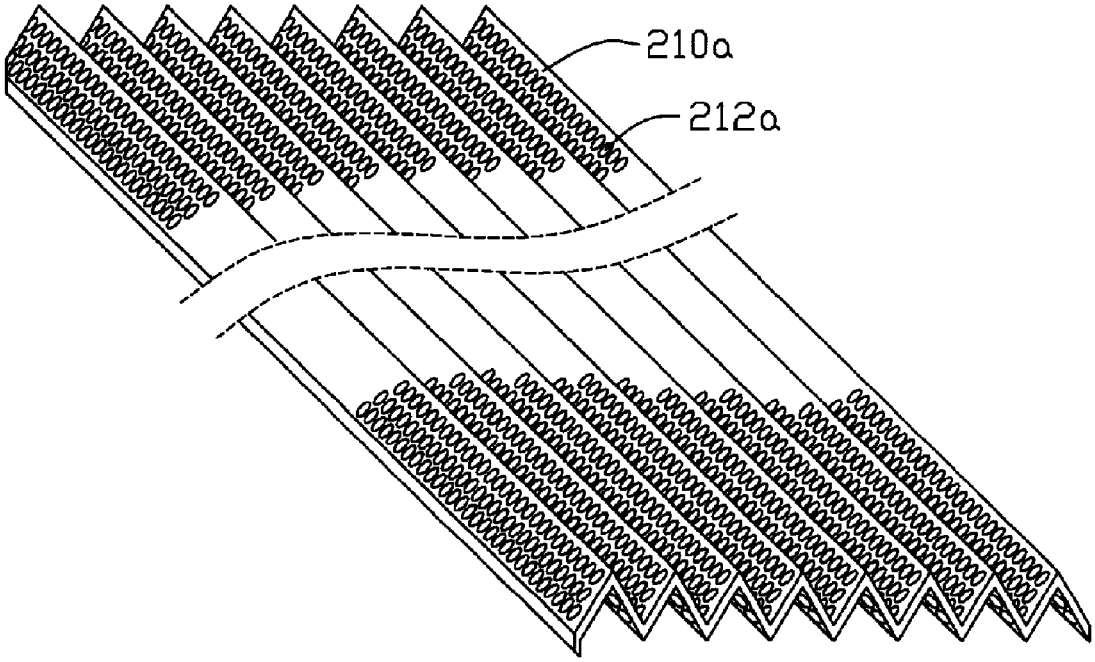
FIG. 6 is an enlarged view of a first slice of a heat pipe in accordance with a second embodiment of the present invention.
Figure 7:
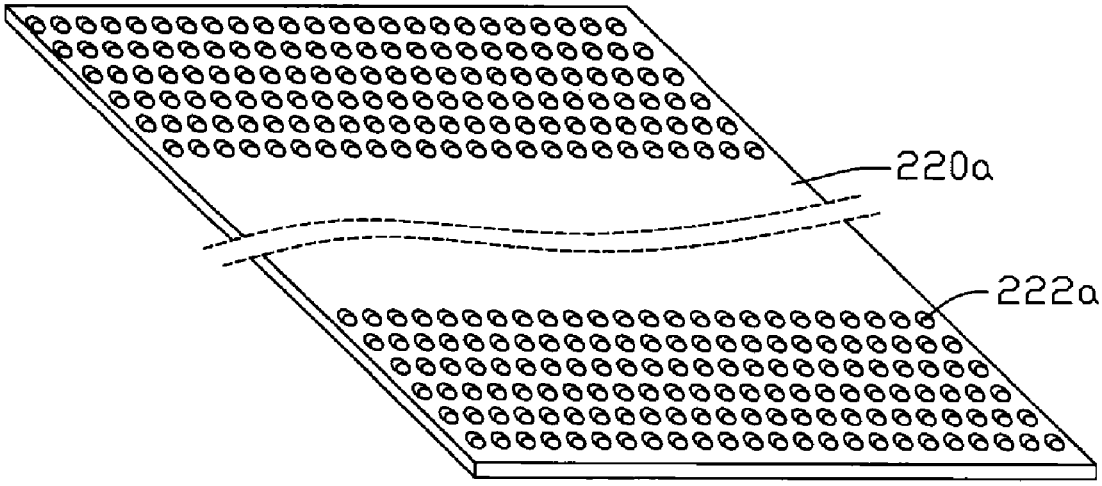
FIG. 7 is an enlarged view of a second slice of the heat pipe in accordance with the second embodiment of the present invention.

FIG. 6 illustrates a first slice 210*a* of a capillary wick of a heat pipe in accordance with a second embodiment of the present invention. FIG. 7 illustrates a second slice 220*a* of the capillary wick of the heat pipe in accordance with the second embodiment of the present invention. In this embodiment, free ends of the first and second slices 210*a*, 220*a* extend toward the evaporating and condensing sections 40, 60. Two opposite portions of the first and second slices 210*a*, 220*a* corresponding to the evaporating and condensing sections 40, 60 define a plurality of pores 212*a*, 222*a*, and the other portions of the first and second slices 210*a*, 220*a* corresponding to the adiabatic section 50 are located between the two opposite portions of the first and second slices 210*a*, 220*a* without any pores.

Figure 8:
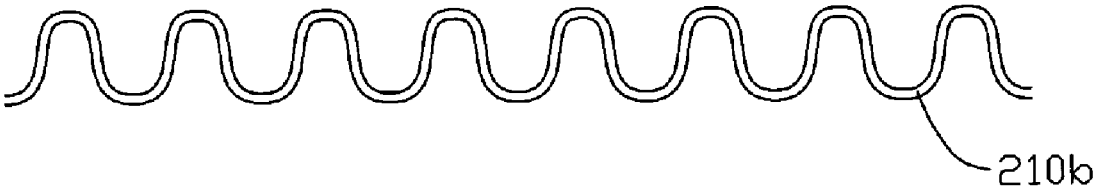
FIG. 8 is side elevation view of a first slice of a heat pipe in accordance with a third embodiment of the present invention.

FIG. 8 illustrates a first slice 210*b* of a capillary wick of a heat pipe in accordance with a third embodiment of the present invention. In this embodiment, the first slice 210*b* has an arced and waved cross section.

Figure 9:
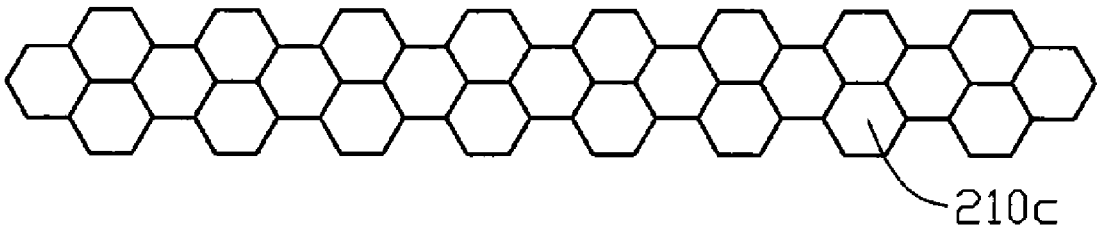
FIG. 9 is a side elevation view of a first slice of a heat pipe in accordance with a fourth embodiment of the present invention.

FIG. 9 illustrates a first slice 210*c* of a capillary wick of a heat pipe in accordance with a fourth embodiment of the present invention. In this embodiment, the first slice 210*c* has a hexagonal and meshed cross section.

Figure 10:
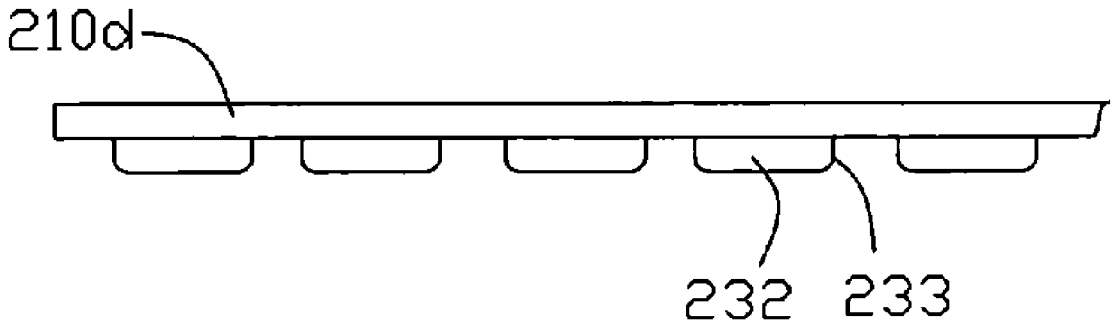
FIG. 10 is a cross-sectional view of a first slice of a heat pipe in accordance with a fifth embodiment of the present invention.

FIG. 10 illustrates a first slice 210*d* of a capillary wick of a heat pipe in accordance with a fifth embodiment of the present invention. In this embodiment, the first slice 210*d* defines a plurality of pores 232 therein. Each of the pores 232 has an annular sidewall 233 that is formed during punching the pores 232.

The heat pipe according to the previous embodiments has a straight configuration and has a round cross section. The heat pipe can be more easily bent to have a complicated shape, such as a U-like shape or an S-like shape and can has a flattened cross section.

In accordance with a preferred embodiment of the present invention, a method for manufacturing the heat pipe comprises steps: 1) providing a mandrel; 2) positioning the isolation structure 30 on an outer circumferential surface of the mandrel; 3) intimately attaching the capillary wick 20 on the isolation structure 30; 4) coaxially inserting the mandrel into the casing 10; 5) placing the casing 10 into an oven (not shown) and heating it under a high temperature to sinter the capillary wick 20, the isolation structure 30 and the casing 10 together; 6) extracting the mandrel out of the casing 10, filling the casing 10 with working liquid, vacuuming the casing 10 and sealing the casing 10. Through these steps, the heat pipe with the capillary wick 20 is produced.

It is known that porosity of the wick structure is an important parameter for the heat transfer capacity of the heat pipe. The capillary wick 20 of the invention is made of the plurality of first and second slices 210, 220 stacked together and defining the plurality of micro-channels 22 therein, whereby the porosity of the capillary wick 20 can be accurately controlled by selecting different configurations and layers of slices 210, 220 to improve the heat transfer performance of the heat pipe.

In theory, when porosity of a heat pipe having a 6 mm diameter increases 1%, the maximum heat transfer capacity increase by 10 Watts. The porosity of the conventional type wick structures such as fine grooves, screen mesh or bundles of fiber, or sintered powder or any combination of the above types, is hard to increase beyond 40%. However, the capillary wick 20 of the invention is not only adaptable to mass production but can also greatly improve the porosity so that it may exceed 80%. Thus, the heat resistance of the heat pipe is reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat pipe comprising:

a hollow metal casing; and a honeycombed wick structure arranged at an inner surface of the hollow metal casing, the wick structure including a plurality of slices stacked together and forming a plurality of micro-channels between the slices, each of the slices defining a plurality of pores therein;

wherein each of the plurality of pores extends towards a direction different from a direction which the plurality of micro-channels extends towards; and wherein each of the pores has an annular sidewall protruding from a surface of a corresponding one of the plurality of slices.

2. The heat pipe of claim 1, wherein the slices include a plurality of wave-shaped first slices and a plurality of flat second slices, the first and second slices being alternatively stacked together.

3. The heat pipe of claim 1, wherein the metal casing has an evaporating section for receiving heat from a heat generating electronic component, a condensing section for releasing the heat and an adiabatic section between the evaporating and condensing sections.

4. The heat pipe of claim 3, further comprising a vapor-liquid isolation member attached on an inner face of the capillary wick at the adiabatic section.

* * * * *